United States Patent [19]

Huber et al.

[11] 4,290,477

[45] Sep. 22, 1981

[54] NOZZLE FOR STRIP CASTING

[75] Inventors: Ernst Huber, Schaffhausen; Wolfhart Rieger, Buch; Martin Bolliger, Sierre, all of Switzerland

[73] Assignee: Swiss Aluminium Ltd., Chippis, Switzerland

[21] Appl. No.: 7,446

[22] Filed: Jan. 29, 1979

[30] Foreign Application Priority Data

Jan. 30, 1978 [CH] Switzerland ..... 991/78

[51] Int. Cl.[3] ..... B22D 11/06; B22D 11/10

[52] U.S. Cl. ..... 164/430; 164/437; 164/440

[58] Field of Search ..... 222/146 AG, 591, 592; 164/430, 431, 432, 434, 429, 427, 437, 439, 440

[56] References Cited

U.S. PATENT DOCUMENTS

| | | | |
|---|---|---|---|
| 2,225,660 | 12/1940 | Rogers | 222/591 X |
| 2,752,649 | 7/1956 | Hunter | 164/430 |
| 3,167,830 | 2/1965 | Hazelett et al. | 164/431 |
| 3,430,683 | 3/1969 | Hood, Jr. | 222/592 X |
| 3,596,804 | 8/1971 | Barrow et al. | 222/591 X |
| 3,746,072 | 7/1973 | Richardson | 164/434 X |
| 3,774,670 | 11/1973 | Gyongyos | 164/430 |
| 3,805,877 | 4/1974 | Ward | 164/434 |

*Primary Examiner*—Robert D. Baldwin
*Assistant Examiner*—Gus T. Hampilos
*Attorney, Agent, or Firm*—Bachman and LaPointe

[57] ABSTRACT

A nozzle which can be used repeatedly for the supply of liquid metal is made up of individual, hollow, refractory sections fitted together side by side in a metal frame. The hollow elements of the nozzle may feature, in addition to at least one longitudinal channel for the supply of liquid metal, channels to accommodate heating elements also running in the longitudinal direction.

21 Claims, 8 Drawing Figures

NOZZLE FOR STRIP CASTING

BACKGROUND OF THE INVENTION

The present invention is drawn to a device used to feed molten metal to caterpillar track molds during strip casting.

Casting machines with caterpillar track molds have been developed for the continuous strip casting of aluminum and other metals, the mold being formed by a double row of mold halves which make up two endless moving belts. At the end at which molten metal is fed to the mold the facing mold halves unite and move in this fashion over a certain distance over which they form the actual caterpillar track mold. The mold halves then separate and in a short time meet again at the metal inlet end.

Casting in caterpillar track type molds has been known in the art for some time. (E. Herrmann, Handbuch des Stranggiessens, Düsseldorf 1958, p. 51 ff.).

In the case of casting machines with caterpillar type molds for casting relatively thin strip e.g. 20 mm thick and less, the nozzle for the supply of liquid metal is the most sensitive component. This is mainly due to the fact that there are few materials which can withstand the high temperatures of the hot metal flowing through this part. When the metal being cast is aluminum or an aluminum alloy the nozzle must withstand erosion or dissolution by the metal.

Nozzles for metal feeding have been developed and typical nozzles are described in the U.S. Pat. No. 2,752,649 and the Swiss Pat. No. 508,433 and in the Handbuch des Stranggiessens, pages 60 and 61. The parts of the nozzle which come into contact with the liquid metal are made of a refractory material made up of a mixture of 30% diatomaceous earth (almost pure silica in the form of microscopic cells), 30% asbestos fibres, 20% sodium silicate (dry weight) and 20% lime (to form calcium silicate). Such materials are commercially available under the trade names "Marinite" and "Marimet".

The nozzle described in U.S. Pat. No. 2,752,649 is intended for casting relatively thick aluminum sections which are rectangular in cross section. The mouth of the nozzle features a central front part which runs perpendicular to the axis of the hollow mold space and two sides set back at an angle. The main route for the molten metal in the nozzle branches off at the mouth in such a manner that in practice a stream of metal is directed at an angle against each of the narrow sides of the space in the mold and another stream is directed forwards. As a result, the metal solidifies from the narrow sides towards the middle and the central stream of metal fills the shrinkage gap which forms as the metal solidifies.

This known type of nozzle can not be used for casting relatively thin, wide strips (e.g. 700 to 1500 mm wide and larger, and about 20 mm thick). In addition, the shape of the nozzle mouth is of no use in casting thin, wide strips.

For such a case the same applicant has already developed a nozzle which is provided with inserts of a self lubricating material near the outer edge of the mouthpiece around its whole circumference. These inserts project so far over the surface of the mouthpiece that they prevent any direct contact of the nozzle surface with the mold halves and prevent liquid metal from penetrating the space caused by the play between the mouthpiece and the mold halves.

Although the above mentioned nozzles are made of refractory material and exhibit good thermal insulation and low heat capacity, there is a basic disadvantage in that the material used is not very homogeneous in terms of chemical composition and mechanical properties. It absorbs moisture and is subject to irreversible changes in chemical composition on heating to operating temperature and is thus susceptible to an associated embrittlement or low mechanical strength which, as a rule, allows the nozzle to be used only once.

In spite of the above mentioned low heat capacity and poor thermal conductivity of the known ceramic materials the nozzle must be pre-heated before casting in order to prevent the metal from freezing prematurely at the start of casting.

The object of the present invention is to construct a device for feeding the melt during strip casting in caterpillar track type molds. A further object is to make the device out of a material which will allow the said device to be used repeatedly.

SUMMARY OF THE INVENTION

The objects of the present invention are achieved by way of a device which features a plurality of hollow sections which are mounted side by side in a metal frame. The sections are made of a high melting point, heat resistant material and serve as outlet nozzles.

The device of the present invention is set preferably in equipment for melt feeding such as described by the applicant in FIG. 1 of the Swiss Pat. No. 508 433. In this way the nozzle elements, which are in the form of hollow sections, are arranged side by side in a frame which is made, for example, out of free machining cast steel of low thermal expansion characteristics and in two parts which can be bolted together.

The hollow sections made of high melting point, heat resistant material are chemically and mechanically stable. They are only slightly or not at all hygroscopic and are not or only poorly wet by liquid metal. In addition they are resistant to thermal shock and will not distort. The requirements with respect to these properties are all met and, surprisingly, in some cases are exceeded.

High melting point, heat resistant materials which have proved particularly suitable for this application are: aluminum titanate, silicon nitride, silicon oxynitride, silicon carbide, silicon-aluminum oxynitride, titanium boride, aluminum oxide, zirconium silicate, magnesium-aluminum spinel, calcium zirconate, silicon oxide, Cordierite, zirconium oxide and carbon. These materials can be employed alone or as mixtures.

It has been found that the resistance to thermal shock of the nozzle elements of the present invention is so great that pre-heating of the nozzle before casting can be eliminated.

The device may be provided with additional channels which allow the device to be heated. These channels are located adjacent and parallel to the channels for supplying the molten metal.

The nozzle elements can be of any geometrical shape in cross section. Likewise the cross-sectional shape of the channels for conveying the liquid metal and for accommodating a heating element can be of any desired geometrical form. The shape is limited only by the methods of manufacture available and by costs. The hollow sections are usefully rectangular and relatively narrow in shape. The above mentioned channels are usefully rectangular too, but can also be circular or of some other shape.

To increase the stability of the device, the abutting sides of the neighboring hollow sections may be designed so that they engage one another.

At least a part of the channels for the heating element can be formed by appropriately shaping the hollow sections which lie side by side.

The heating of the nozzles by means of the channels which accommodate a heating element can be done in different ways. One possible method is for these channels to be fitted with at least one electrical conductor in the form of wires, coils, or strips which can be heated by resistance heating. These conductors are made, preferably, of a metal with relatively low specific electrical conductivity. Particularly suitable for the conductor material are chromium-nickel alloys or one of the iron base alloys which has found common use as electrical resistance material and contains high concentrations of chromium, aluminum and cobalt. In another embodiment of the present invention the nozzle can be heated without installing electrical resistance elements but instead by blowing hot air through these channels.

Using the hollow sections of the present invention a nozzle can be manufactured so that its surfaces coming in contact with the liquid metal are heated over the whole length to a temperature above the melting point of the metal. Further, the thermal balance of the nozzle can be influenced at any moment during casting.

To enable the metal to flow into the mold in a flat, uninterrupted stream, a mouthpiece may be mounted on the outlet side of the row of nozzle elements. This mouthpiece is likewise made of a material which has a high melting point and heat resistant. In addition the outlet of the mouthpiece is slit-shaped.

The mouthpiece can be connected to the nozzle elements without forming a step at the junction and can be secured there using conventional joining elements.

An additional embodiment of the mouthpiece may be designed such that the mouthpiece is pushed over the row of nozzle elements and engages with them by virtue of shape. Such a mouthpiece is advantageous if the nozzle elements engage with each other at their sides and are held together in a plane in this manner. The nozzle elements can not move relative to one another in a direction vertical to this plane thus reducing the danger of the mouthpiece being damaged by mechanical stressing. This is particularly important if the material from which the mouthpiece is made is a soft material such as "Marinite".

BRIEF DESCRIPTION OF THE DRAWINGS

The schematic drawings show in cross section various rectangular embodiments of nozzle elements in accordance with the present invention wherein.

DETAILED DESCRIPTION

Figure 1:
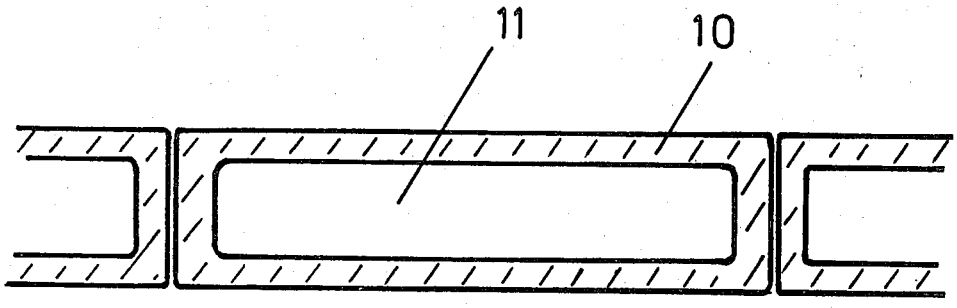
FIG. 1 is a cross section through a nozzle element with a channel for the molten metal.

FIG. 1 shows a cross section through a nozzle element 10 with a channel 11 for supplying molten metal extending over almost the whole width of the element 10.

Figure 2:
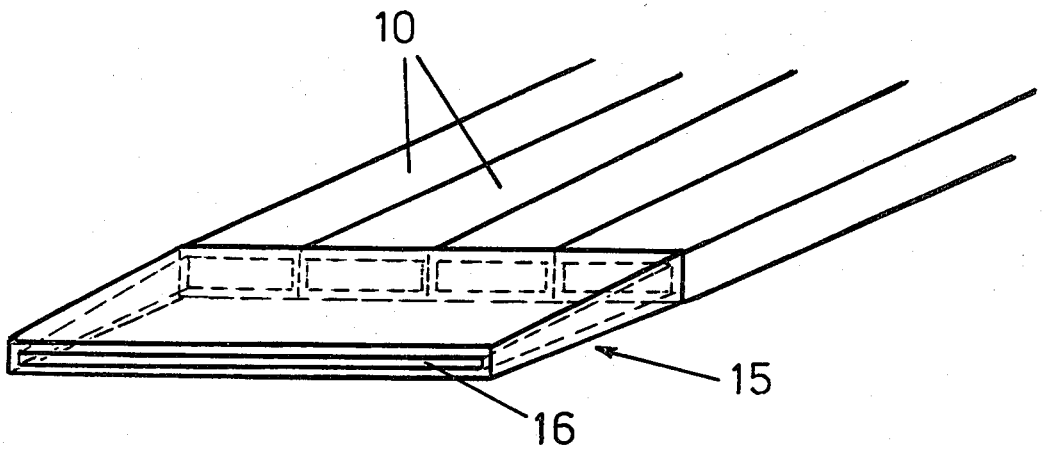
FIG. 2 is a perspective view of nozzle elements arranged side by side and fitted with a mouthpiece.

In FIG. 2 a mouthpiece 15 with a slit-shaped outlet 16 has been mounted on the row of nozzle elements 10 lying side by side. The mouthpiece 15 connects up smoothly on all sides with the row of nozzle elements 10.

Figures 3, 4, 5:
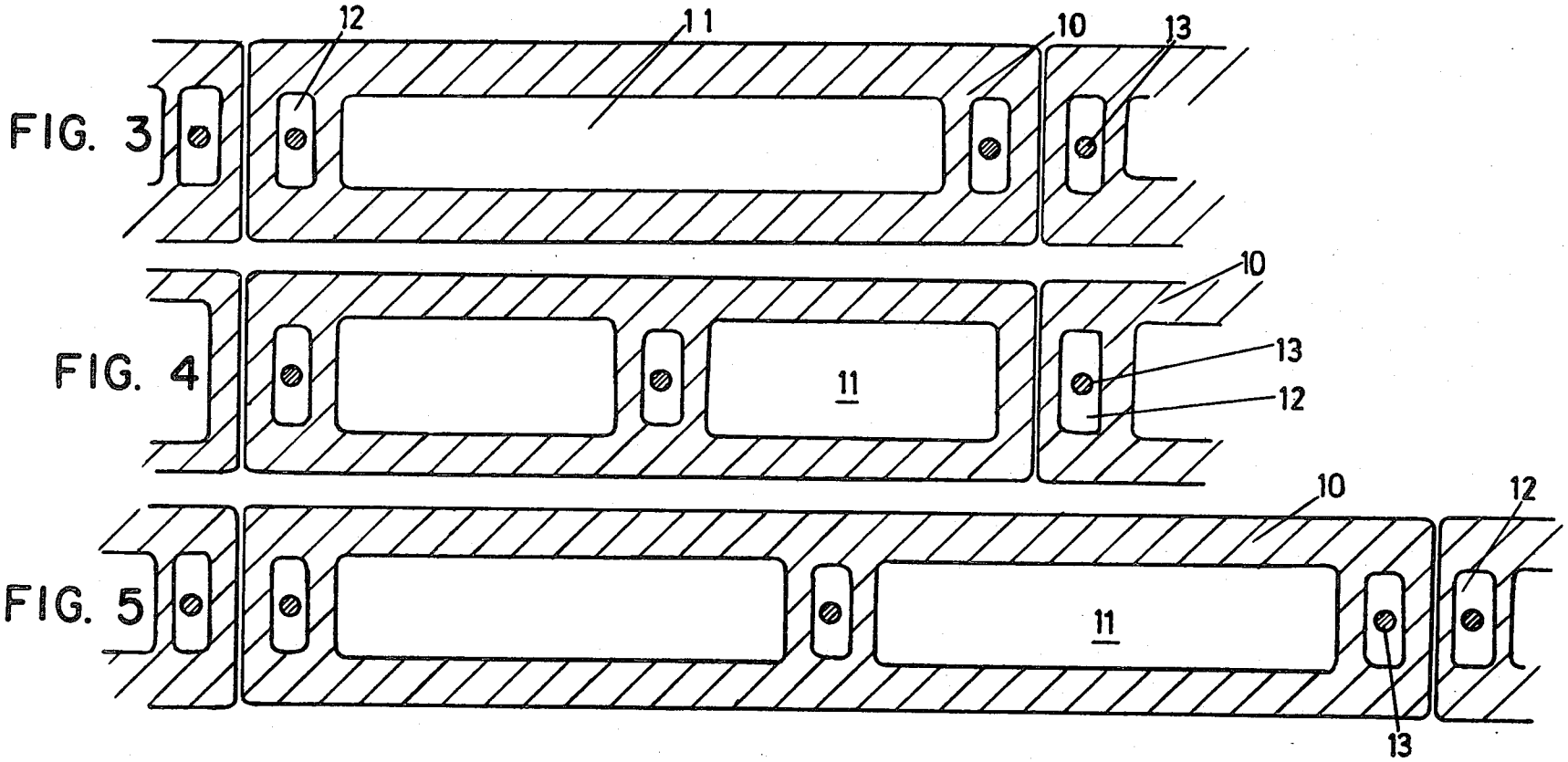
FIG. 3 is a cross-sectional view of a nozzle element with a central channel for the supply of liquid metal and two peripheral channels for resistance heating elements.
FIG. 4 is a cross-sectional view of a nozzle element with two asymmetrical pairs of channels for the supply of liquid metal, and for accommodating resistance heating elements.
FIG. 5 is a cross-sectional view of a nozzle element which has two channels for the supply of molten metal arranged symmetrically side by side, and three channels to accommodate resistance heating.

FIG. 3 shows a nozzle element 10 which has a channel 11 for the supply of liquid metal extending practically over its whole width. Outside this channel there are provided two channels 12 which are symmetrical to the long axis of the element and in each of which there is an electrical conductor 13. If these elements are laid side by side then a relatively unfavourable arrangement results, as two heating elements lie side by side whilst there are no heating elements across the breadth of the metal feed channels.

In the hollow section 10 in FIG. 4 there are two channels 11 for the supply of the melt and two channels 12 for the electrical conductor 13 arranged alternately side by side. On laying these elements 10 side by side care is taken that this alternating arrangement of both kinds of channels is repeated over the whole width of the nozzle. Each of the channels 11 for supplying the melt is flanked by two electrically heated conductors. Such an arrangement provides a uniform temperature profile over the whole width of the nozzle.

The symmetrical arrangement in FIG. 5 of two channels 11 for feeding the melt and three channels 12 for the electrically heated conductor 13 represents an improvement over FIG. 3 as there is a further heating element in the middle of the nozzle element.

Figure 6:
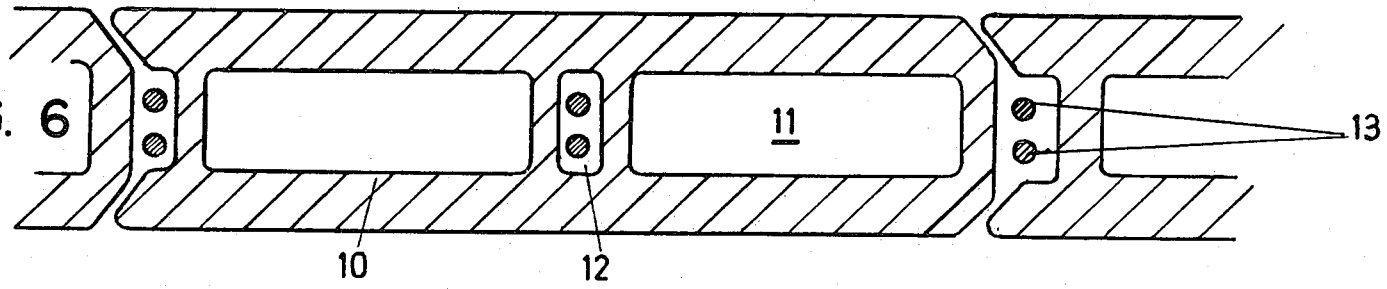
FIG. 6 is a cross-sectional view of a nozzle element with two channels for the supply of liquid metal, and a central channel for the resistance heating, and ends designed to form a further channel.

FIG. 6 represents in principle a version of the nozzle element shown in FIG. 4. The peripheral channels for the electrical conductor shown in FIG. 4 is however not closed, but open in such a way that by fitting a pair of elements side by side a channel is formed. In this example two electrical conductors are provided in each channel.

Figure 7:
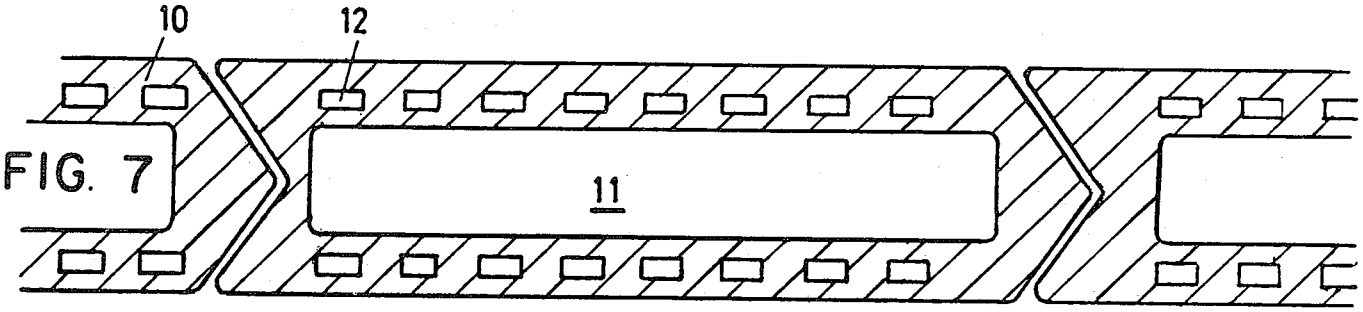
FIG. 7 is a cross-sectional view of a nozzle element with a channel for the supply of liquid metal, and a plurality of channels for the passage of hot air.

FIG. 7 shows nozzle elements 10 which feature a channel 11 for the liquid melt extending over the whole width of the element. In the lower and upper wall of the nozzle element there are channels 12 which are not heated by an electrical conductor, but instead by means of hot air.

Figure 8:
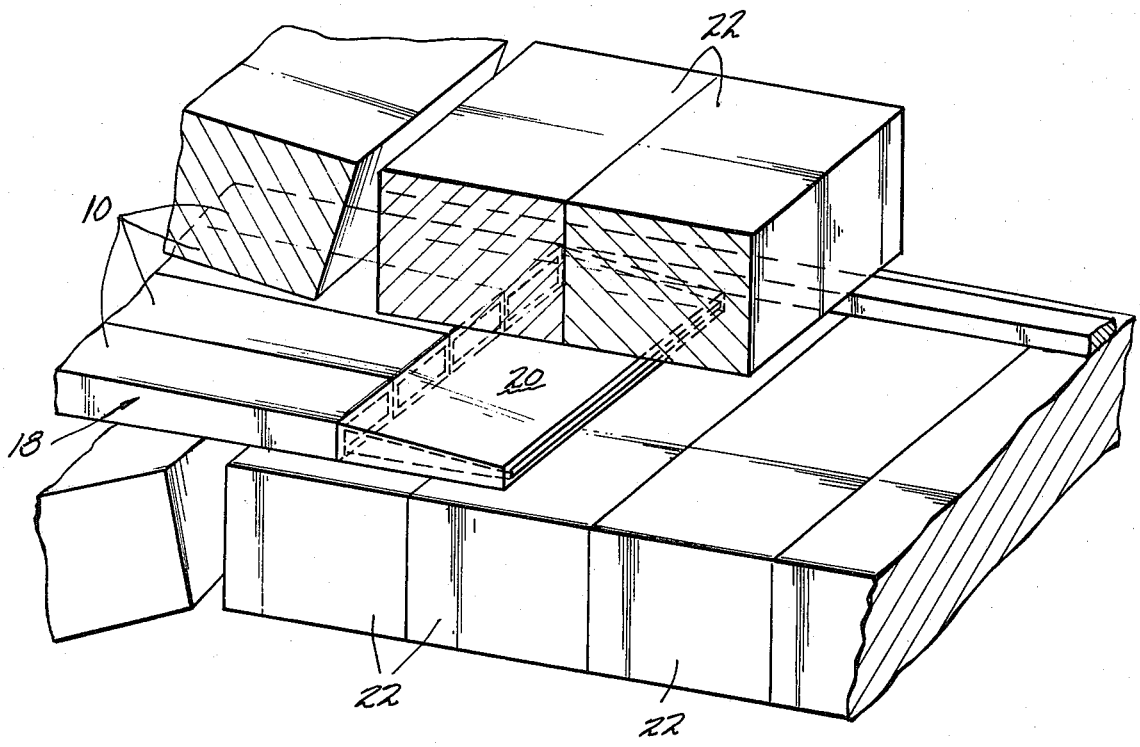
FIG. 8 is a perspective view of the nozzle of the present invention projecting into the mold interior of a strip casting machine having caterpillar type molds.

FIG. 8 shows one embodiment of the nozzle of the present invention comprising a feed portion 18 made up of a plurality of individually separable hollow elongated tubular sections 10 and a tip portion 20. The nozzle protrudes into the mold cavity formed by the mold halves 22 of a caterpillar type strip casting machine as for example shown in U.S. Pat. No. 3,570,586.

EXAMPLE

Elements which were 480 mm long, 67.5 mm broad and 17 mm high were made out of aluminum titanate ($Al_2TiO_5$) by conventional methods used in the technology of ceramic materials. The geometrical form of this part, which has a wall thickness of 4 mm, is shown in FIG. 1. The individual elements were held together by a metal frame to form a 405 mm wide nozzle. Heating elements made of an iron base alloy with high concentrations of chromium, aluminum and cobalt, with a heating capacity of 1 kW and 450 mm in length were introduced into the heating channels. The heating was designed in such a way that both connections could be made on the same side of the nozzle frame. The nozzle was then fitted with thermocouples on the inside walls of the metal feed channels so that it was possible to measure the temperature as a function of the heat supplied. By gradually heating up the electrical heating elements in the heating channels it was possible to follow the change in temperature on the inside of the metal feed channels. These measurements showed that, when the temperature of the heating element was 1200° C., the temperature on the inside of the melt feed channel was between 650° C. and 900° C. This temperature is adequate for casting aluminum.

At the same time it could be shown from this work that the aluminum titanate used was completely resistant to thermal shock. The test cycle was carried out six times in succession without the ceramic showing any cracks or any other kind of damage.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. An apparatus for the continuous casting of molten metal comprising in combination a caterpillar track type mold and a nozzle for feeding said molten metal to said mold, the improvement comprising:

a nozzle comprising a plurality of individually separable hollow elongated tubular sections, each of said sections having a peripheral wall defining at least one feed channel, said plurality of sections being mounted in side by side relationship such that a portion of said peripheral wall surface of one of said plurality of sections abuts a portion of said peripheral wall surface of another of said plurality of sections wherein the abutting portions of said peripheral wall surfaces of said plurality of hollow sections form a channel substantially parallel to said at least one feed channel.

2. An apparatus according to claim 1 wherein means for heating said peripheral wall which is in contact with said molten metal is provided in said channel.

3. An apparatus according to claim 1 wherein at least one of said plurality of hollow sections is provided with means for forming a plurality of feed channels.

4. An apparatus according to claim 3 wherein said means comprises a wall provided with an additional heating channel.

5. An apparatus for the continuous casting of molten metal comprising in combination a caterpillar track type mold and a nozzle for feeding said molten metal to said mold, the improvement comprising:

a nozzle having a feed portion and a tip portion, said feed portion comprising a plurality of individually separable hollow elongated tubular sections, each of said sections having a peripheral wall defining at least one feed channel, said plurality of sections being mounted in side by side relationship such that a portion of said peripheral wall surface of one of said plurality of sections abuts a portion of said peripheral wall surface of another of said plurality of sections wherein said abutting portions of said peripheral wall surfaces of said plurality of hollow sections form a channel substantially parallel to said at least one feed channel, said channel formed by said abutting portions of said peripheral wall surfaces being provided with means for heating the surface of said peripheral wall which is in contact with said molten metal.

6. An apparatus according to claim 5 wherein said portion of said peripheral wall of said one section abuts said portion of said peripheral wall of said another section over the entire length of said elongated sections.

7. An apparatus according to claim 5 wherein said tip portion abuts said feed portion downstream of said plurality of hollow sections and is provided with a slit run-out for feeding molten metal to said mold.

8. An apparatus according to claim 5 wherein at least one of said plurality of hollow sections is provided with means for forming a plurality of feed channels.

9. An apparatus according to claim 8 wherein said means comprises a wall provided with an additional heating channel.

10. An apparatus according to claim 5 wherein said tip portion encases a portion of said feed portion and is provided with a slit run-out for feeding molten metal to said mold.

11. An apparatus according to claim 5 wherein said plurality of hollow sections are securely mounted in a frame member.

12. An apparatus according to claim 5 wherein said plurality of hollow sections comprise a high melting point heat resistant material.

13. An apparatus according to claim 12 wherein said material is selected from the group consisting of aluminum titanate, silicon oxide, silicon nitride, silicon carbide, silicon oxynitride, silicon-aluminum oxynitride, zirconium oxide, zirconium silicate, calcium zirconate, magnesium-aluminum spinel, carbon and mixtures thereof.

14. An apparatus according to claim 5 wherein said at least one heating channel is provided with at least one electrical conductor.

15. An apparatus according to claim 14 wherein said electrical conductor is made of a material characterized by a low specific conductivity.

16. An apparatus according to claim 15 wherein said material is a chromium-nickel alloy.

17. An apparatus according to claim 15 wherein said material is a ferrous alloy having high concentrations of chromium, cobalt and aluminum.

18. An apparatus according to claim 5 wherein said at least one heating channel is provided with means for passing hot air therethrough.

19. An apparatus for the continuous casting of molten metal comprising in combination a caterpillar track type mold and a nozzle for feeding said molten metal to said mold, the improvement comprising:

a nozzle comprising a plurality of individually separable hollow elongated tubular sections, each of said sections having a peripheral wall defining at least one feed channel, said plurality of sections being mounted in side by side relationship such that a portion of said peripheral wall surface of one of said plurality of sections abuts a portion of said peripheral wall surface of another of said plurality of sections wherein said abutting portions of said peripheral wall surfaces of said plurality of hollow sections form at least one heating channel substantially parallel to said at least one feed channel for heating the surface of said peripheral wall which is in contact with said molten metal.

20. An apparatus according to claim 19 wherein at least one of said plurality of hollow sections is provided with means for forming a plurality of feed channels.

21. An apparatus according to claim 20 wherein said means comprises a wall provided with an additional heating channel.

* * * * *